US008475198B2

(12) United States Patent
Wu

(10) Patent No.: US 8,475,198 B2
(45) Date of Patent: Jul. 2, 2013

(54) PLUG CONNECTOR HAVING AN IMPROVED LATCHING MECHANISM

(75) Inventor: Jerry Wu, Irvine, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/316,849

(22) Filed: Dec. 12, 2011

(65) Prior Publication Data

US 2012/0149222 A1 Jun. 14, 2012

(51) Int. Cl.
*H01R 13/627* (2006.01)

(52) U.S. Cl.
USPC ..... 439/352; 439/358

(58) Field of Classification Search
USPC ..... 439/352, 357, 358, 155
See application file for complete search history.

(56) References Cited

U.S. PATENT DOCUMENTS

| | | | | |
|---|---|---|---|---|
| 7,134,914 | B1 | 11/2006 | Wu | |
| 7,281,937 | B2 | 10/2007 | Reed et al. | |
| 7,473,124 | B1 * | 1/2009 | Briant et al. | 439/352 |
| 7,494,363 | B1 | 2/2009 | Wu | |
| 7,540,755 | B1 * | 6/2009 | Wu | 439/352 |
| 7,559,785 | B1 | 7/2009 | Wu | |
| 7,938,669 | B2 * | 5/2011 | Li et al. | 439/352 |

* cited by examiner

*Primary Examiner* — Neil Abrams
*Assistant Examiner* — Travis Chambers
(74) *Attorney, Agent, or Firm* — Ming Chieh Chung; Wei Te Chung

(57) ABSTRACT

A plug connector (100) mating with a complementary connector includes a housing (1) and a latching mechanism (4) having a latch (41) and a puller (42). The latch includes a latching portion (411) provided with a claw (4110), a bar section (412) secured in the base, and a connecting portion (413) having a forwardly extending abutting portion (4133). The puller includes an actuator (422) and an operator (421) supported on the bar section and having an engaging portion (4217) engaged with the abutting portion. The operator slides rearwardly, in response to a rearward movement of the actuator, to upwardly and rearwardly move the engaging portion together with the abutting portion to thereby lift the claw from a latched position to a released position.

17 Claims, 7 Drawing Sheets

PLUG CONNECTOR HAVING AN IMPROVED LATCHING MECHANISM

CROSS-REFERENCE TO RELATED APPLICATIONS

This patent application is related to a pending U.S. patent application Ser. No. 13/236,085, filed on 2011 Sep. 9, and entitled "PLUG CONNECTOR HAVING AN IMPROVED LATCHING MECHANISM", which is invented by the same inventor as this patent application and assigned to the same assignee with this application.

BACKGROUND OF THE INVENTION

1. Field of the Invention

The present invention generally relates to a plug connector, and more particularly to a plug connector used for high-speed signal transmission.

2. Description of Related Art

A committee called SFF is an ad hoc group formed to address storage industry needs in a prompt manner. When formed in 1990, the original goals were limited to define de facto mechanical envelopes within disk drives can be developed to fit compact computer and other small products.

U.S. Pat. No. 7,559,785 issued to Wu on Jul. 14, 2009 discloses a plug connector mating with a complementary connector. The plug connector comprises a housing, a latching mechanism having a driver and a latch assembled to the housing, and a metal shell attached to the housing. The driver has a head portion provided with a resisting portion, a shaft and a depressing portion opposite to the resisting portion relative to the shaft. The latch has a nest engageable with the resisting portion, and a latching portion provided with a pair of claws. The metal shell has a resilient beam resisting against the pressing portion of the driver. The driver is rotatable around the shaft to move the latch together with the claws between a latching position and an unlatching position, due to an engagement between the resisting portion of the driver and the nest of the latch.

The metal shell should be formed with a resilient beam resisting against the pressing portion of the driver in order to rotate the driver. The plug connector has a complicated configuration and the latching mechanism takes a difficult operation.

U.S. Pat. No. 7,134,914 issued to Wu on Nov. 11, 2006 discloses a plug connector for mating with a complementary connector. The plug connecting comprises a housing, a latching mechanism having a driver and a latch assembled to the housing, and a metal shell attached to the housing. The driver has a head portion provided with a resisting portion, and an actuator opposite to the head portion. The latch has a nest engageable with the resisting portion, a beam portion inclining rearwardly downwardly from the nest, and a latching portion provided with a pair of claws. When the actuator is pulled rearwardly, the resisting portion moves rearwardly and slides along the inclined beam portion to lift the latching portion from a latching position to a released position. The driver has a clumsy configuration and operates the latching portion in a unique way.

Hence, a plug connector having an improved latching mechanism is desired.

BRIEF SUMMARY OF THE INVENTION

Accordingly, an object of the present invention is to provide a plug connector having a latching mechanism having a simple configuration and capable of taking an easy operation.

In order to achieve the above-mentioned object, a plug connector mating with a complementary connector comprises a housing and a latching mechanism. The housing includes a base having a supporting face and a tongue portion extending forwardly from the base for fitting with the complementary connector. The latching mechanism includes a latch and a puller. The latch includes a latching portion provided with a claw, a bar section secured in the base, and a connecting portion connected between the latching portion and the bar section and having a forwardly extending abutting portion. The puller includes an actuator and an operator opposite to the actuator. The operator is supported on the bar section and has an engaging portion engaged with the abutting portion. The operator slides rearwardly, in response to a rearward movement of the actuator, to upwardly and rearwardly move the engaging portion together with the abutting portion to thereby lift the claw from a latched position to a released position.

It is easy to drive the latching mechanism to perform the latching and releasing operation, if only rearwardly pulling the puller or releasing the puller. The latching mechanism has a simple light configuration and is capable to take an easy operation.

Other objects, advantages and novel features of the invention will become more apparent from the following detailed description of the present embodiment when taken in conjunction with the accompanying drawings.

DETAILED DESCRIPTION OF THE INVENTION

Figure 1:
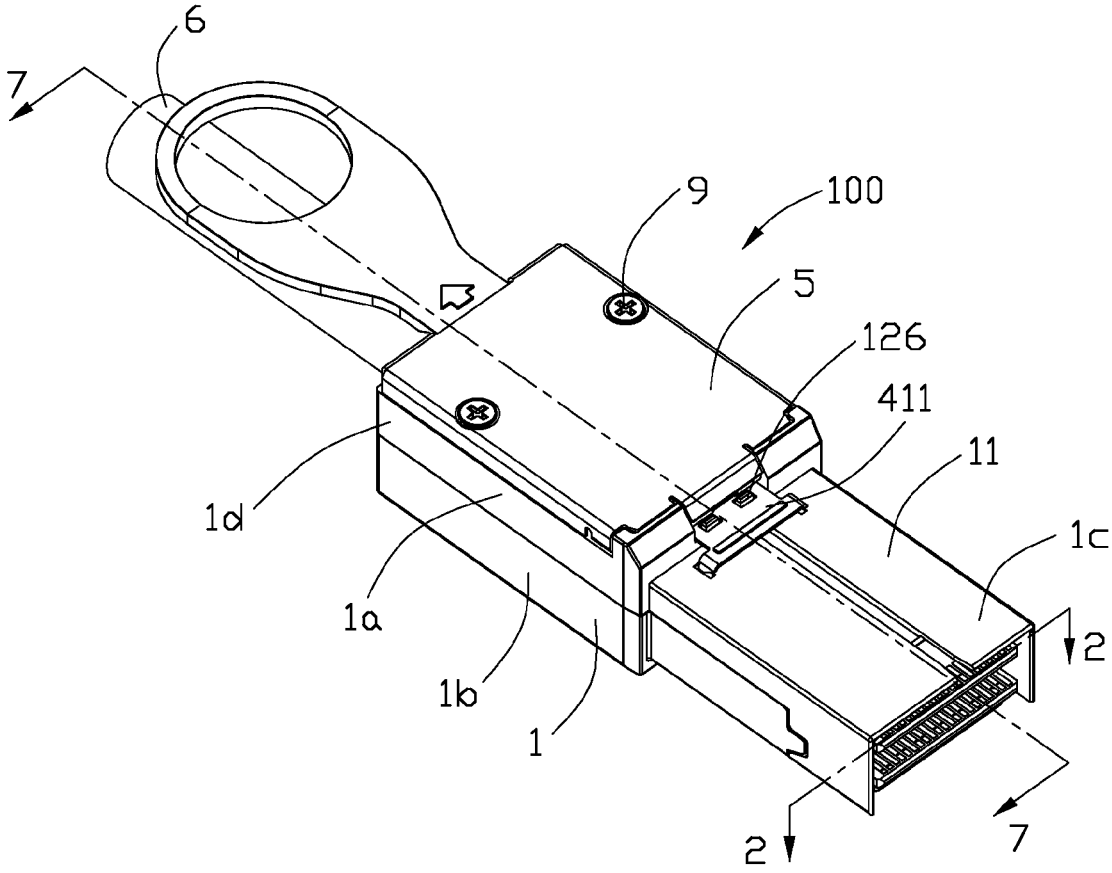
FIG. 1 is an assembled perspective view of a plug connector in accordance with the present invention.
Figure 2:
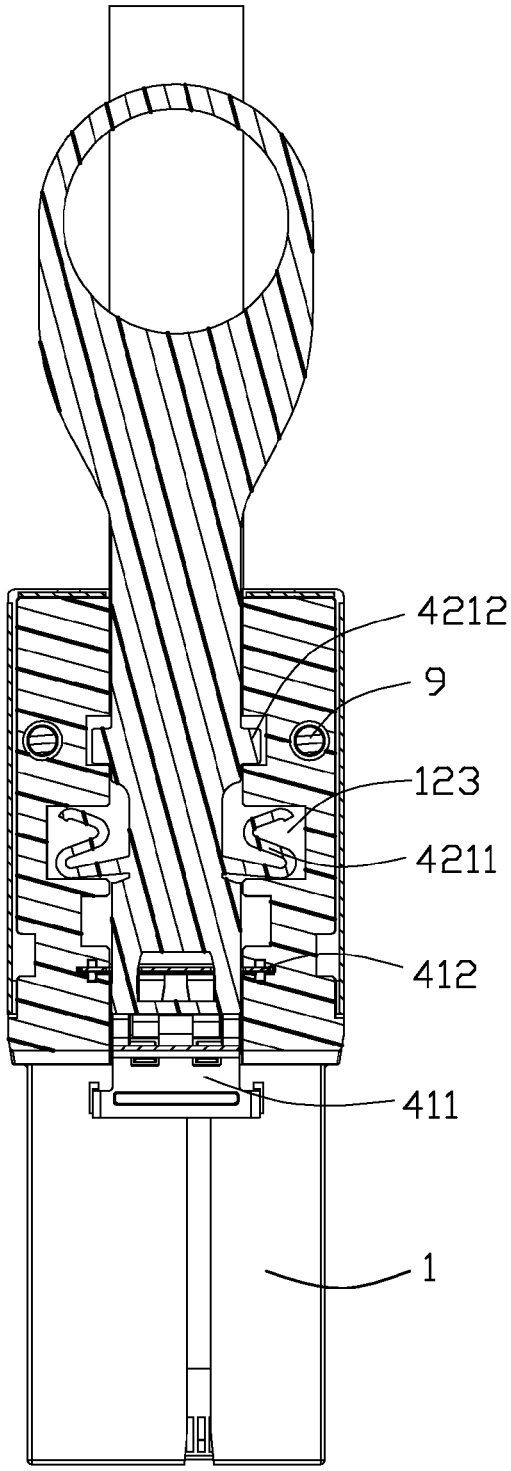
FIG. 2 is a cross-sectional view of the plug connector, taken along line 2-2 of FIG. 1.
Figure 3:
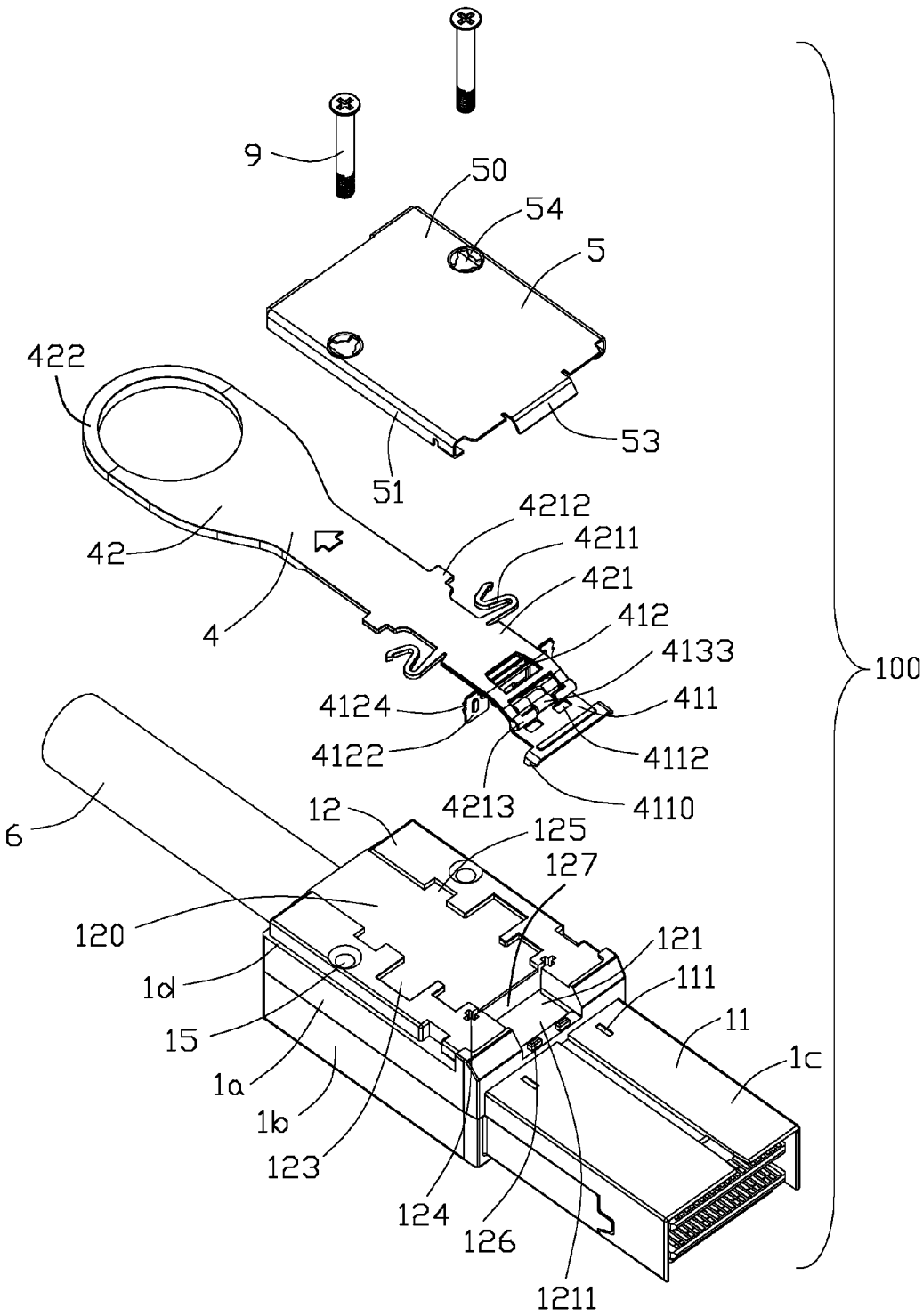
FIG. 3 is a partially exploded perspective view of the plug connector as shown in FIG. 1, with a metal shell and a latching mechanism being separated.
Figure 4:
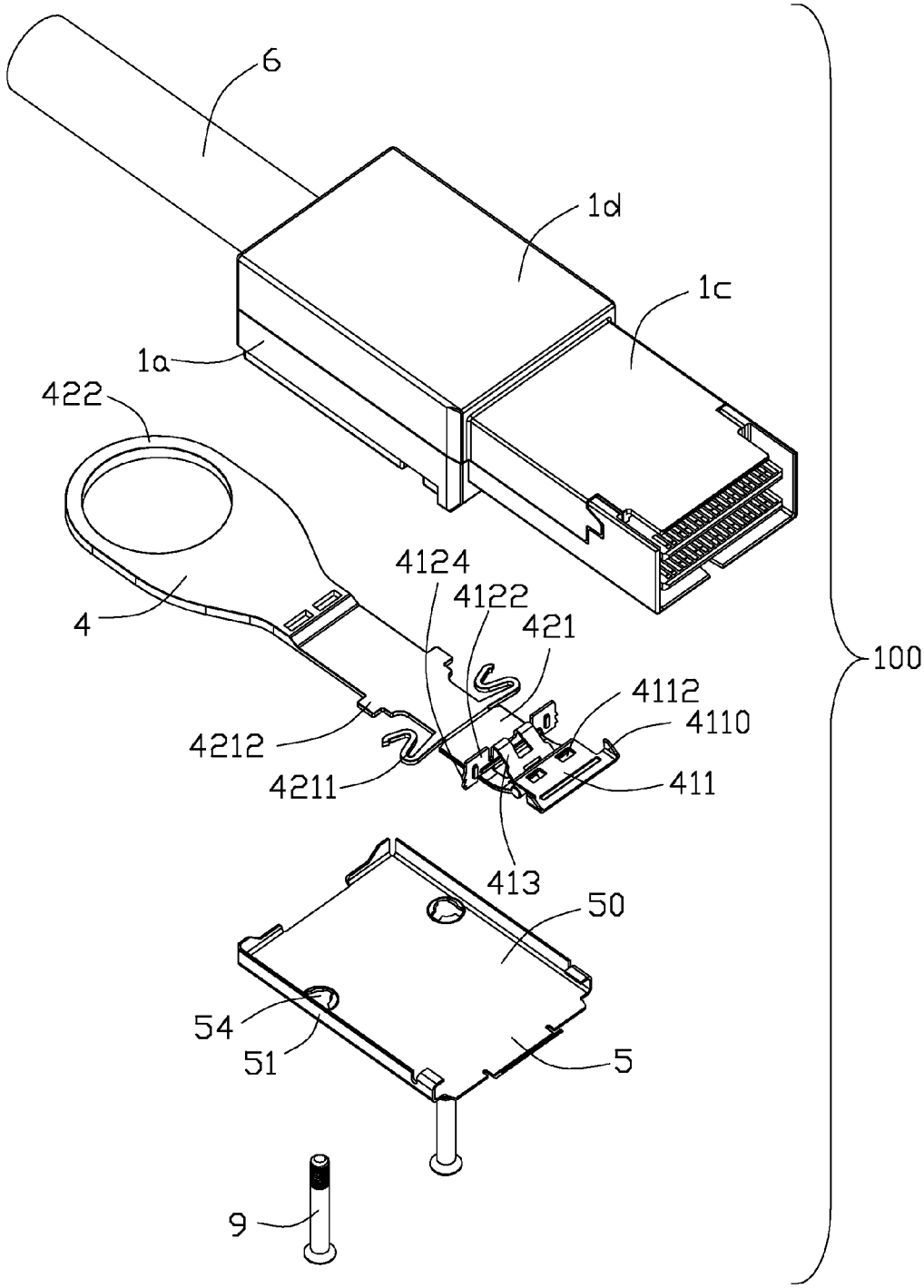
FIG. 4 is another partially exploded view similar to FIG. 3, taken from another aspect.
Figure 5:
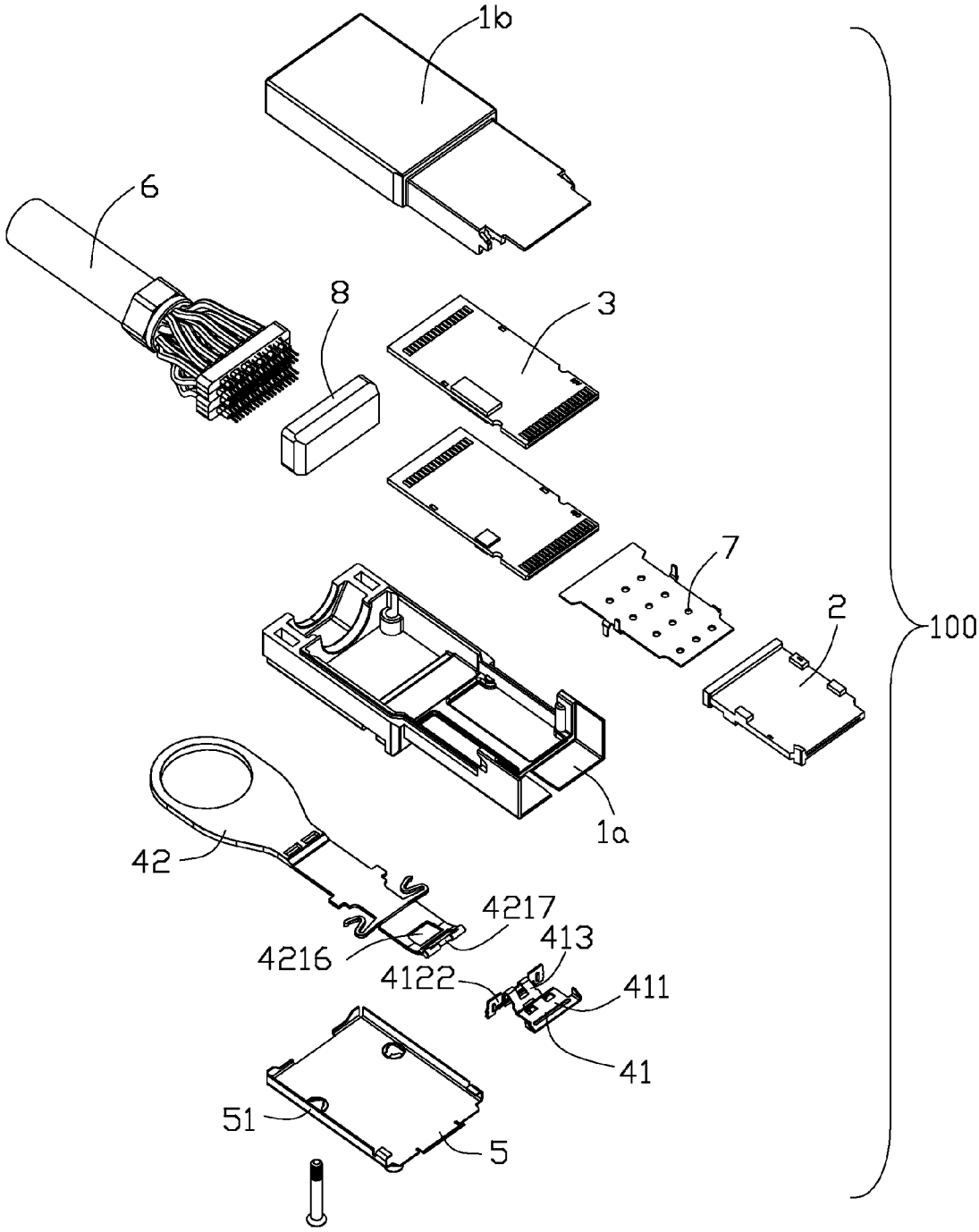
FIG. 5 is an exploded perspective view of the plug connector as shown in FIG. 1.

Reference will now be made to the drawing figures to describe the present invention in detail.

Referring to FIGS. 1-6, a plug connector 100 mating with a complimentary connector (not shown) in accordance with the present invention comprises a housing 1, a bracket 2, a pair of circuit boards 3, a shielding plate 7 received in the housing 1, a cable 6 electrically connected to the circuit boards 3 via a connecting member 8, a latching mechanism 4 assembled to the housing 1, a metal shell 5 attached to the housing 1 and partially covering the latching mechanism 4, and a plurality of screws 9 fixing the metal shell 5 on the housing 1. If desired, the cable 6 can be replaced by other suitable structures or interfaces.

Referring to FIGS. 1-5, the housing 1 comprises an upper portion 1*a* and a lower portion 1*b* engaged with each other to define a receiving space (not shown) therebetween for retaining the bracket 2, the pair of circuit boards 3 and the shielding plate 7. Both upper portion 1*a* and lower portion 1*b* are preferably die-casted. The housing 1 has a base 1*d* and an elongated tongue portion 1*c* extending forwardly from the base 1*d*.

The base 1*d* has a top face 12. The top face 12 has a concave recess 120, and a receiving recess 121 at a level lower than the concave recess 120 to form a vertically extending resisting wall 127 disposed adjacent to the concave recess 120 and facing the receiving recess 121. The concave recess 120 defines a pair of ear recesses 125, a pair of retaining recesses 123 in front of the ear recesses 125, and a pair of downwardly extending screw holes 15.

The receiving recess 121 has a flat supporting face 1211 disposed therein, a pair of securing slots 124 substantially aligned with the resisting wall 127, and a pair of protrusions 126 formed at a front edge of the receiving recess 121.

The tongue portion 1*c* has an upper face 11 at a level lower than the top face 12. The upper face 11 defines a pair of latching slits 111.

Referring to FIGS. 3-6, the latching mechanism 4 comprises a latch 41 and a puller 42 assembled to the latch 41. The latch 41 is made of metal material and is formed into a cantilever-type. The latch 41 comprises a transverse bar section 412, a flat latching portion 411 located in a horizontal surface and an inclined connecting portion 413 connecting the bar section 412 and the latching portion 411.

The bar section 412 has a pair of securing portions 4122 formed at opposite sides thereof and a pair of cutouts 4125 defined at the upper side thereof. Each securing portion 4122 is formed with a plurality of click portions 4124 on outmost edge thereof.

The flat latching portion 411 defines a pair of rectangular engaging holes 4112, and a pair of claws 4110 bending downwardly from opposite sides of the front edge of the latching portion 411 for clasping the complementary connector.

The connecting portion 413 has a bent portion 4132 bent upperwardly and connected with the flat latching portion 411, and a tail portion 4134 connected with the bar second 412 and extending upwardly across the bar second 412. The connecting portion 413 has an abutting portion 4133 punched therefrom and is bent forwardly. The connecting portion 413 also defines a hole therein for adjusting spring force of the latch 41 through changing size and shape of the hole.

The puller 42 comprises an operator 421, an actuator 422 opposite to the operator 421, a pair of ear portions 4212 and a pair of resilient portions 4211 in front of the ear portions 4212. Each resilient portion 4211 is S-shaped and has a free end connected with the puller 42.

The operator 421 includes a pair of beam portions 4218 separated from each other to define a front opening 4214 and a rear opening 4216 between the pair of beam portions 4218 and a connecting bar 4215 between the front and rear openings 4214, 4216. The operator 421 has a cooperating portion 4213 connected with the pair of beam portions 4218 and in front of the front opening 4214, and an engaging portion 4217 formed at a middle portion of the cooperating portion 4213.

The metal shell 5 comprises a flat top wall 50, a pair of L-shaped side walls 51 extending from opposite side edges of the top wall 50, a front flange 53 extending from a front edge of the top wall 50, and a pair of mounting holes 54 defined in the top wall 50.

Referring to FIGS. 1-6, in assembling of the plug connector 100, the bracket 2 is received in the housing 1. The pair of circuit boards 3 are attached to upper and lower sides of the bracket 2. The shielding plate 7 is inserted through the bracket 2 and is electrically connected with the pair of circuit boards 3. The cable 6 is electrically connected to the circuit boards 3 via the connecting member 8.

The latching mechanism 4 is assembled to the housing 1. The puller 42 is mounted in concave recess 120, with the ear portions 4212 received in the ear recesses 125 and the resilient portions 4211 plunged in the retaining recesses 123.

The latch 41 is inserted in the receiving recess 121. The bar section 412 is resisted against the resisting wall 127, and the securing portions 4122 are secured in the securing slots 124, with the click portions 4124 engaged with the securing slots 124. The pair of engaging holes 4112 engage with the pair of protrusions 126. The operator 421 of the puller 42 is supported on the bar section 412, with the beam portions 4218 accommodated in the cutouts 4125, the tail portion 4134 inserted in the rear opening 4216 and the bent portion 4132 plunged in the front opening 4214 along an bottom-to-up direction. The engaging portion 4217 is abutted to the abutting portion 4133.

The metal shell 5 is fixed on the housing 1 and partially covers the latching mechanism 4, with the screws 9 inserted through the mounting holes 54 into the screw holes 15.

Figure 6:
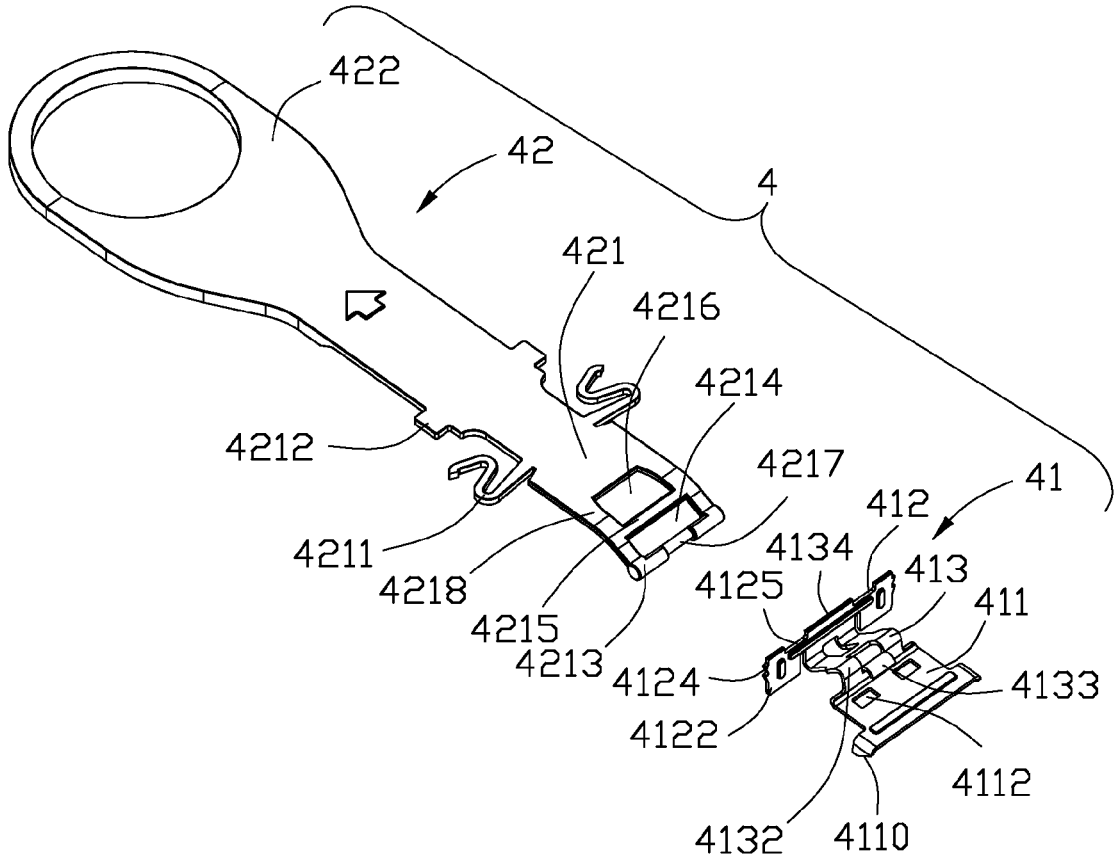
FIG. 6 is a perspective view showing the latching mechanism.

FIG. 6 illustrates the plug connector 100 located in a released position. When the actuator 422 of the puller 42 is pulled rearwardly, the beam portions 4218 slide rearwardly through the cutouts 4125 of the latch 41. At the same time, the cooperating portion 4213 together with the engaging portion 4217 moves upwardly and rearwardly. Due to the engagement between the engaging portion 4217 and the abutting portion 4133, the abutting portion 4133 is operated to move upwardly and rearwardly by the engaging portion 4217. Finally, the latching portion 411 together with the claws 4110 is lifted upwardly from a latched position to a released position. The resilient portions 4211 are compressed in the retaining recesses 123. The ear portions 4212 are movable in the ear recesses 125 along the front-to-back direction to prevent the puller 42 from dropping.

Figure 7:
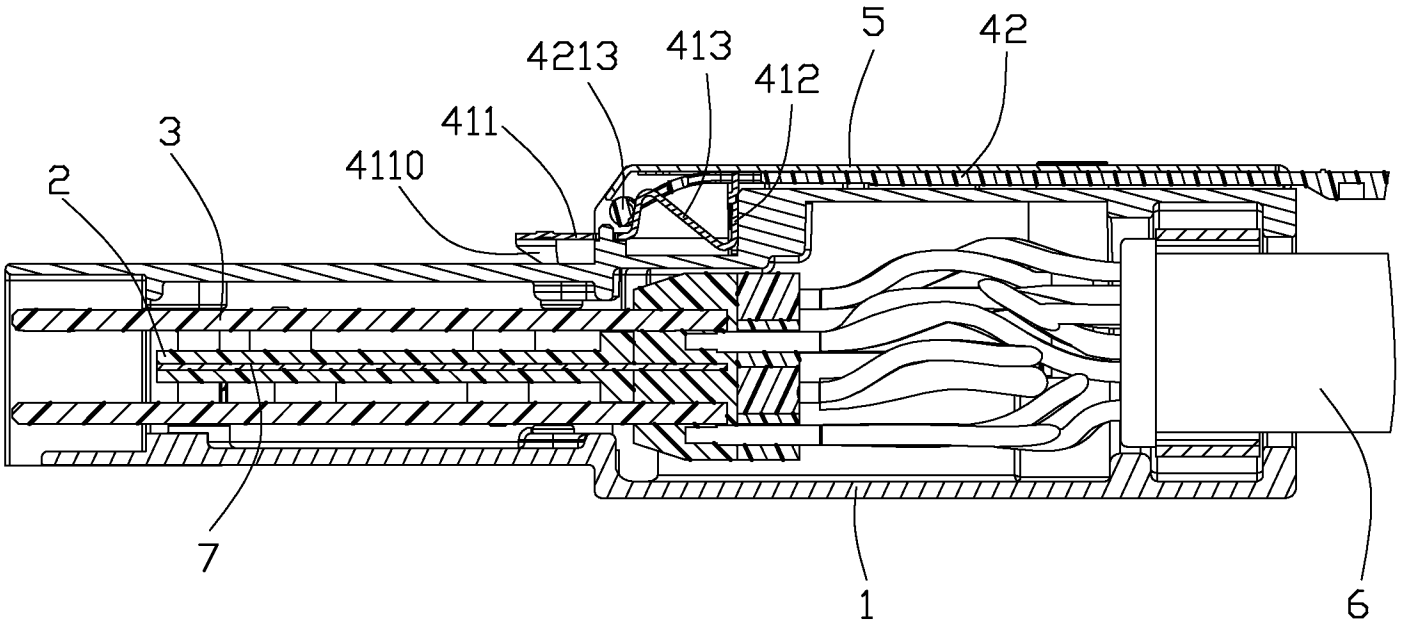
FIG. 7 is a cross-sectional view taken along line 7-7 of FIG. 1, when the latching mechanism is positioned in a released position.

When the plug connector 100 is located in the released position as shown in FIG. 7, the complementary connector could be mounted onto or removed from the plug connector 100. When the actuator 422 of the puller 42 is released, the resilient portions 4212 would restore themselves from the released position to the latched position. The latching mechanism 4 revert to the latched position.

When the actuator 422 is pulled rearwardly, the latch 41 would be driven from the latched position to the released position automatically. When the actuator 422 is released, the latch 41 would restore to the initial position automatically. It is easy to drive the latching mechanism 4 to perform the latching and releasing operation, if only pulling the actuator 422 or releasing the actuator 422. Additionally, the claws 4110 would latch the complementary connector reliably, since the latch 41 restores itself to the latched position via the resilient restoring force provided by the resilient portions 4211. The latching mechanism 4 has a simple configuration and is capable to take an easy operation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector adapted for mating with a complementary connector, comprising:

a housing comprising a base and a tongue portion extending forwardly from the base for fitting with the complementary connector; and a latching mechanism assembled to the base and comprising:

a latch including a latching portion provided with a claw, a bar section secured in the base, and a connecting portion connected between the latching portion and the bar section and having a forwardly extending abutting portion, said abutting portion being positioned substantially forwardly of the remaining part of the connecting portion; and a puller comprising an actuator and an operator opposite to the actuator, said operator being supported on the bar section and having an engaging portion engaged with the abutting portion, said operator being slidable rearwardly, in response to a rearward movement of the actuator, to upwardly and rearwardly move said engaging portion together with the abutting portion to thereby lift the claw from a latched position to a released position.

2. The plug connector as claimed in claim 1, wherein said abutting portion is punched from the connecting portion and is bent forwardly.

3. The plug connector as claimed in claim 1, further comprising a metal shell attached to the base for partially covering the latching mechanism.

4. The plug connector as claimed in claim 1, wherein said bar section of the latch has a pair of cutouts defined at an upper portion thereof, and said operator of the puller comprises a pair of beam portions sliding through the cutouts and a cooperating portion connected with the pair of beam portions, said engaging portion being formed at a middle portion of the cooperating portion.

5. The plug connector as claimed in claim 4, wherein said operator of the puller has a front opening defined behind the cooperating portion, said connecting portion having a bent portion received in the front opening.

6. The plug connector as claimed in claim 5, wherein said operator of the puller includes a rear opening behind the front opening and between the pair of beam portions, said connecting portion having a tail portion extending upwardly through the rear opening.

7. The plug connector as claimed in claim 4, wherein said base of the housing defines a receiving recess for positioning the latch and a concave recess for accommodating the puller, said receiving recess having a flat supporting face supporting the latch.

8. The plug connector as claimed in claim 7, wherein said receiving recess has a pair of protrusions formed therein, and said latching portion of the latch defines a pair of engaging holes engaged with the pair of protrusions.

9. The plug connector as claimed in claim 7, wherein said claw extends downwardly from the latching portion, and said tongue portion is formed with a latching slit corresponding to the claw.

10. The plug connector as claimed in claim 7, wherein said concave recess is at a level higher than the receiving recess to form a vertically extending resisting wall adjacent to the concave portion and facing the receiving recess and a pair of securing slots substantially aligned with the resisting wall, said bar section resisting against the resisting wall and having a pair of securing portions secured in the securing slots.

11. The plug connector as claimed in claim 7, wherein said concave recess defines a pair of ear recesses, and the puller has a pair of ear portions moveable in the pair of ear recesses along a front-to-back direction.

12. The plug connector as claimed in claim 7, wherein said concave recess defines a pair of retaining recesses, and said puller has a pair of resilient portions compressibly retained in the retaining recesses.

13. The plug connector as claimed in claim 12, wherein each resilient portion is S-shaped and has a free end connected with the puller.

14. A plug connector comprising:

a housing defining an inner receiving space and an outer operation space;

a latching mechanism assembled to the housing and including:

a unitary metallic latch defining a rear retention section assembled to the housing, a front claw section and an abutment section therebetween in a front-to-back direction; and an insulative puller including a rear actuator for holding by hand and a front operator for urging the latch to move; wherein said front operator defines a transverse bar grasped by the abutment section and supported by an upward bent section from which said abutment section is stamped so as to assure that no relative movement between the abutment section of the latch and the transverse bar during operation; wherein the transverse bar is located in front of the upward bent section and essentially sandwiched between the abutment section and the upward bent section in said front-to-back direction.

15. The plug connector as claimed in claim 14, wherein a joint of said abutment section and the bent section confronts and endures forces derived from the transverse bar when the puller is moved rearwardly to deflect the latch.

16. The plug connector as claimed in claim 14, wherein said abutment section split from the bent section, essentially extends forwardly.

17. A plug connector adapted for mating with a complementary connector, comprising:

a housing comprising a base and a tongue portion extending forwardly from the base for fitting with the complementary connector; and a latching mechanism assembled to the base and comprising:

a latch including a latching portion provided with a claw, a bar section secured in the base, and a connecting portion connected between the latching portion and the bar section and having a forwardly extending abutting portion, said bar section having a pair of cutouts defined at an upper portion thereof; and a puller comprising an actuator and an operator opposite to the actuator, said operator being supported on the bar section and having an engaging portion engaged with the abutting portion, said operator further comprising a pair of beam portions sliding through the cutouts, a cooperating portion connected with the pair of beam portions, a front opening defined behind the cooperating portion, and a rear opening behind the front opening and between the pair of beam portions, said connecting portion having a bent portion received in the front opening and a tail portion extending upwardly through the rear opening, said engaging portion formed at a middle portion of the cooperating portion, said operator being slidable rearwardly, in response to a rearward movement of the actuator, to upwardly and rearwardly move said engaging portion together with the abutting portion to thereby lift the claw from a latched position to a released position.

* * * * *